US005119135A

United States Patent [19]

Baldwin

[11] Patent Number: 5,119,135

[45] Date of Patent: Jun. 2, 1992

[54] SELECTIVELY VARIABLE IMAGE POSITIONING SYSTEM FOR USE IN ELECTROPHOTOGRAPHIC COPYING APPARATUS

[75] Inventor: LeRoy A. Baldwin, Rochester, N.Y.

[73] Assignee: Xerox Corporation, Stamford, Conn.

[21] Appl. No.: 739,036

[22] Filed: Aug. 1, 1991

[51] Int. Cl.[5] ..... G03G 21/00

[52] U.S. Cl. ..... 355/218; 355/55; 355/243

[58] Field of Search ..... 355/55, 56, 218, 235, 355/243; 359/676, 813, 823

[56] References Cited

U.S. PATENT DOCUMENTS

| | | | |
|---|---|---|---|
| 4,162,844 | 7/1979 | Traister et al. | 355/218 |
| 4,209,248 | 6/1980 | Gibson et al. | 355/235 |
| 4,530,592 | 7/1985 | Green et al. | 355/243 |
| 4,639,121 | 1/1987 | Looney | 355/235 |
| 4,782,361 | 11/1988 | Spinelli et al. | 355/317 |
| 4,816,867 | 3/1989 | Ito | 355/218 |
| 4,980,723 | 12/1990 | Buddendeck et al. | 355/218 |
| 5,016,051 | 5/1991 | Morikawa et al. | 355/218 |
| 5,049,932 | 9/1991 | Sumida | 355/218 |

*Primary Examiner*—A. T. Grimley
*Assistant Examiner*—William J. Royer
*Attorney, Agent, or Firm*—Denis A. Robitaille

[57] ABSTRACT

An electrophotographic copying apparatus is disclosed having an imaging system for selectively shifting an image on an output copy sheet in response to a particular image shift selection by a operator. Electronic input signals, representative of selective image position, are transmitted to a system control circuit via a user interface device which, in turn, generates a signal for transmission to a lens drive circuit. The lens positions the image at the appropriate location on the photoreceptor so as to properly position the output image on the output copy sheet in accordance with the selected image shift. An algorithm is provided for determining the appropriate lens position relative to its "home" position and for accomplishing required lens movement.

24 Claims, 6 Drawing Sheets

SELECTIVELY VARIABLE IMAGE POSITIONING SYSTEM FOR USE IN ELECTROPHOTOGRAPHIC COPYING APPARATUS

The present invention relates generally to electrophotographic copying apparatus and, more particularly, concerns an imaging system for selectively shifting the position of an image of an original input document on an output copy sheet.

Generally, the process of electrophotographic reproduction is executed by exposing a light image of an original document to a substantially uniform charged photoreceptive member. Exposing the charged photoreceptive member to a light image discharges the photoconductive surface thereof in areas corresponding to non-image areas in the original document while maintaining the charge on the image areas to create an electrostatic latent image of the original document on the photoconductive surface of the photoreceptive member. The latent image is subsequently developed into a visible image by depositing a charged developing material onto the photoconductive surface so that the developing material is attracted to the charged image areas thereon. The developing material is then transferred from the photoreceptive member to an output copy sheet on which the image may be permanently affixed in order to provide a reproduction of the original document. In a final step in the process, the photoreceptive member is cleaned to remove any residual developing material on the photoconductive surface thereof in preparation for successive imaging cycles.

In a typical document reproduction machine, a document is placed on a transparent platen support and aligned against a registration edge either by a fiducial mark or by a mechanical stop. A horizontal registration edge along the platen border has been found to be the most convenient configuration for an operator since it serves not only to register a document but also to deskew it. After proper placement of the document on the platen, the document is exposed to a light source to produce a light image which is projected onto the surface of a photoreceptor for transfer onto an output copy sheet. The result is an input image having document edges which are ideally aligned with corresponding registration edges on the output copy sheet upon which the developed image is transferred.

Frequently, light lens copier customers have a requirement for specifically positioning the output image of the original document onto the output copy sheet at a location that is different than the position dictated by the architecture of that particular copier. Heretofore, meeting such a requirement was handled by an operator locating a vertical guide at either the right or left edge of the document platen such that the operator, aided by a fiducial marker, must estimate the location of the image on the output copy sheet. This procedure is, necessarily, imprecise and difficult to repeat.

Various methods and systems have been used in the prior art to position the latent image of an original input document on a photoreceptor so that the position of the photocopied image on the output copy sheet is different than that dictated by the system architecture. In general, prior art systems merely provide imaging systems for maintaining image registration on a given image plane for an output document. However, in systems incorporating variable magnification modes and/or automatic, or semi-automatic document feeding devices for transporting an original document onto a platen surface, different registration positions are required depending on the system mode of operation. Therefore, adjustments must be made, either to a movable registration guide or to other system parameters such as copy paper position in order to maintain proper image registration.

Other schemes, such as advance or delay of flash illumination, or modification of transfer timing, have also been used to partially fulfill output image positioning requirements. There is no teaching for selective vertical and horizontal positioning of an image on an output document by repositioning of an optical system lens. The following disclosures appear to be relevant:

- U.S. Pat. No. 5,016,051, Patentee: Marikawa, Issued: May 14, 1991.
- U.S. Pat. No. 4,980,723, Patentee: Buddendeck, et al., Issued: Dec. 25, 1990.
- U.S. Pat. No. 4,782,361, Patentee: Spinelli, et al., Issued: Nov. 1, 1988.
- U.S. Pat. No. 4,639,121, Patentee: Looney, Issued: Jan. 27, 1987.
- U.S. Pat. No. 4,530,592, Patentee: Green, et al., Issued: Jul. 23, 1985.
- U.S. Pat. No. 4,162,844, Patentee: Traister, et al., Issued: Jul. 31, 1979.

The relevant portions of the foregoing disclosures may be briefly summarized as follows:

Marikawa discloses a scanning exposure-type copying machine having a device for entering the position on a copy sheet where a copy image corresponding to a document image is to be formed. According to the device of this patent, the operation timing of the copy sheet feeder is controlled in order to position the copy sheet so that the copy image is formed at a specific position on the copy sheet.

Traister, et al. describe a reproduction machine having a duplex image shift system for shifting the electrostatic latent image on a photoconductive belt by changing the timing of the image producing means to modify the location of a developed image on a photoreceptor. The image shift is adjusted so that the images on opposite sides of a copy sheet are in registration.

Green, et al. disclose an optical imaging system in which the projection lens undergoes a three-dimensional movement to maintain corner registration of the document at the image plane. The corner registered system of this patent is characterized by aligning the edges of documents copied along leading edges of a latent image so that the latent image edge ideally coincides with a corresponding leading edge of a copy sheet to which the developed image is transferred.

Looney discloses a document registration system having an optical scanning system including a movable projection lens coupled to control means for maintaining a center-registered image dependent on the various modes of operation of the machine, i.e. open-platen mode, document feeder mode, as well as various magnifications, and/or output copy sizes, as selected by the operator.

Spinelli, et al. describe an imaging system with a plurality of document registration positions enabling documents of various sizes to be registered via a lens drive and control circuit for determining lens position wherein the lens position is compared to a home position to move the lens to a new position associated with the particular registration in view of magnification or other document transport modes.

Buddendeck, et al. describe an electrophotographic printing machine wherein horizontal image shift is accomplished by decreasing the processing speed so that the electrostatic latent image is shifted relative to its designated position on the photoreceptor.

It is therefore, desirable to provide an electrophotographic copying apparatus adapted to provide electrical originals representative of corner registration shift selection including a projection lens, a lens drive means and control means for movement of the projection lens in accordance with the electrical signals to selectively position an image on an output copy sheet. The copying apparatus should also be adapted to provide electrical signals representative of magnification selection wherein the control means is further adapted to move the projection lens in response to the magnification signals as a function of a particular corner registration shift selection.

According to one aspect of the invention, an electrophotographic copying apparatus is provided comprising a user interface device adapted to provide signals corresponding to horizontal and vertical position shift of an image on an output copy sheet so that output images are positioned on the output copy sheet at a position prescribed by an operator. Selective operator inputs provide signals representative of vertical and horizontal image shift, which are, in turn, transmitted to a system control circuit for generating output signals to a lens drive circuit to move the lens to the position required for positioning the image at the appropriate location on the photoreceptor. An algorithm is provided for determining the appropriate lens position and for accomplishing the required lens motion.

According to another aspect of the invention, the lens is translated toward and away from the photoreceptor during reduction or enlargement modes of operation, respectively, while maintaining the desired corner registration shift of the output image throughout magnification changes.

For a general understanding of the present invention, as well as other aspects thereof, reference is made to the following description and drawings, in which.

Figure 1:
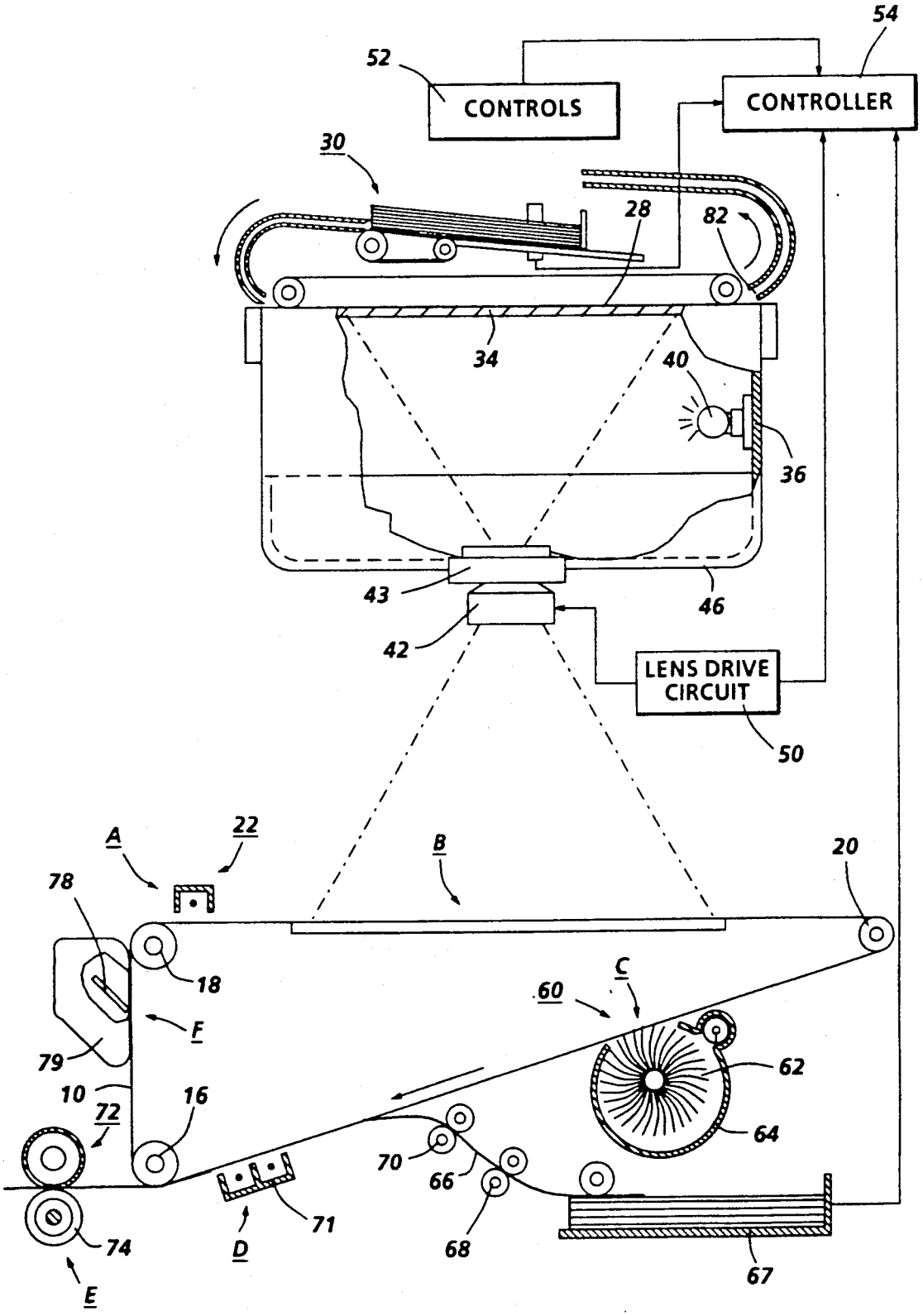
FIG. 1 is a schematic side view of an electrophotographic copying apparatus incorporating the selectively variable image positioning system of the present invention.

While the present invention will be described with reference to a preferred embodiment thereof, it will be understood that the invention is not to be limited to the preferred embodiment. On the contrary, it is intended that the present invention cover all alternatives, modifications, and equivalents as may be included within the spirit and scope of the invention as defined by the appended claims. Other aspects and features of the present invention will become apparent as the description proceeds wherein like reference numerals have been used throughout to designate identical elements.

Inasmuch as the art of electrophotographic reproduction is well known, the various processing stations employed in the reproduction system of the present invention will be described briefly hereinafter with reference to the schematic representation shown in FIG. 1. It will become apparent from the following discussion that the imaging system of the present invention is equally well suited for use in a wide variety of light lens electrophotographic reproduction machines. In particular, it should be noted that the image positioning system and accompanying algorithm of the present invention, described hereinafter with reference to an exemplary electrophotographic copying apparatus, may also be used in conjunction with an optical system wherein a plurality of document registration positions are necessary. Such systems which provide a plurality of document registration positions may also involve lens positioning or repositioning in order to enable documents of various sizes to be registered at different registration positions so that projected images have one side aligned along a common edge parallel to the edge of the photoreceptor.

Turning now to FIG. 1, a schematic depiction of the various components of an exemplary electrophotographic copying apparatus incorporating the image positioning system of the present invention is provided. Preferably, the electrophotographic copying apparatus employs a belt 10 having a photoconductive surface deposited on an electrically grounded conductive surface. Belt 10 is entrained about drive roller 16 driven by conventional motor means, not shown, and tension rollers 18, 20. Drive roller 18 engages with belt 10 for inducing belt 10 to travel in the indicated process direction about a curvilinear path defined by rotatably mounted rollers 16, 18 and 20 thereby advancing successive portions of belt 10 through various processing stations disposed about the path of movement thereof, as will be described. Preferably, the photoconductive surface of belt 10 is made from a selenium alloy while the conductive substrate thereof is made from an aluminum alloy so that belt 10 has characteristics as disclosed in U.S. Pat. No. 4,265,990, the contents of which are hereby incorporated by reference.

In order to produce an electrophotographic reproduction of an input document, a portion of belt 10 initially passes through charging station A where a corona generating device, indicated generally by the reference numeral 22, charges the photoconductive surface to a relatively high, substantially uniform potential. Once charged, the photoconductive surface of belt 10 is advanced to exposure station B. At the exposure station B, an original document 28 is positioned face down upon a transparent platen 34 and exposed to a light source such as a flash lamp 40 within a light housing 36, the top surface of which is defined by platen 34. Feeder mechanism 30 places document 28 in a position for exposure on platen 34. In a preferred embodiment, platen 34 is vertically movable with respect to lens 42 to adjust for conjugate changes during document magnification. It should be understood that the document could be positioned either manually or by a semi-automatic document handler (SADH) or by a computer form feeder (CFF), as will be discussed below.

Upon exposure, the light rays from lamp 40 are reflected from the original document 28, forming a light image thereof, which is transmitted through lens 42. Lens 42 focuses the light image onto a charged portion of the photoconductive surface of the belt 10, selectively dissipating the charge thereon to record an electrostatic latent image corresponding to the original document 28 onto belt 10. Lens 42, mounted on carriage 43, is seated in an aperture formed in housing floor 46. Preferably, all the interior surfaces of the housing 36 are coated with a highly reflective material in order to provide surfaces which are diffusely reflective to light impinging thereon so that the light from lamp 40 irradiates the underside of the platen with a generally uniform level of illumination. The housing thus effectively functions as a highly efficient light integrating cavity for providing a generally uniform illumination level along the bottom of the object plane.

Lens 42 is movably mounted on carriage 43 so as to move horizontally and/or vertically towards or away from the photoreceptor. The lens movement is accomplished by lens drive control circuit 50 under control of the system controller 54 coupled to user interface controls 52, as will be described in greater detail below. The mounting carriage 43 provides the capability to reposition the lens 42 at the particular location required or selected by the operator to provide the selected output image position as a function of magnification. Appropriate mechanisms for moving platen 34 and floor 46 for maintaining total conjugate position as well as focus in response to selective magnification levels are disclosed in U.S. Pat. No. 4,530,592, the contents of which are hereby incorporated by reference.

After the electrostatic latent image is recorded on the photoconductive surface of belt 10, the belt 10 advances to development station C where a magnetic brush development system, indicated generally by the reference numeral 60, deposits a developing material onto the electrostatic latent image. Preferably, magnetic brush development system 60 includes at least one developer roller 62 disposed within a developer housing 64. Developer roller 62 transports developing material comprising both toner particles and carrier beads into contact with the latent image on the photoconductive surface of belt 10. As the developing material is brought into contact with belt 10, the latent image thereon attracts the toner particles away from the carrier granules of the developing material to form a toner powder image on the photoconductive surface of belt 10.

After the toner particles have been deposited onto the photoconductive surface of belt 10 to develop the electrostatic latent image thereon, belt 10 advances the developed images to transfer station D. At the transfer station D, an output copy sheet 66 is removed from a supply tray 67 and transported into contact with the toner powder image by means of feed rollers 68, 70. Each output copy sheet 66 is advanced into contact with the belt 10 in a timed sequence so that the developed image thereon contacts the advancing output copy sheet 66 at transfer station D. A corona generating device 71 is further provided for spraying ions onto the backside of sheet 66 to induce the transfer of toner material from the developed image on belt 10 to the output copy sheet 66.

Output copy sheet 66 is subsequently transported to fusing station E where a fusing roller assembly affixes the transferred powder image onto the output copy sheet 66. Fusing station E includes a fuser assembly for permanently affixing the transferred image to output copy sheet 66. The fuser assembly preferably comprises a heated fuser roller 72 and a support roller 74 spaced to receive copy sheet 66 therebetween. The toner image is thereby forced into contact with the fuser roller 72 to fuse and permanently affix the toner image to sheet 66. After fusing, the copy sheet 66 advances to an output tray (not shown) for subsequent removal of the finished output copy by an operator.

A final processing station, namely cleaning station F, is provided for removing residual toner particles from the photoconductive surface of belt 10 after the output copy sheet 66 is separated from the belt 10. Cleaning station F includes an adjustably mounted blade 78 for physically contacting the photoconductive surface of belt 10 and removing toner particles therefrom. The toner particles are removed from the photoconductive surface and stored in a cleaning housing chamber 79. Cleaning station F further includes a discharge lamp (not shown) for flooding the photoconductive surface of belt 10 with light to dissipate any residual electrostatic charge remaining thereon in preparation for a subsequent imaging cycle.

The foregoing description should be sufficient for purposes of the present application for patent to illustrate the general operation of an electrophotographic copying apparatus incorporating the features of the present invention. As described, an electrophotographic copying apparatus may take the form of any of several well known devices or systems. Variations of specific electrostatographic processing subsystems or processes may be expected without effecting the operation of the present invention.

Figure 2:
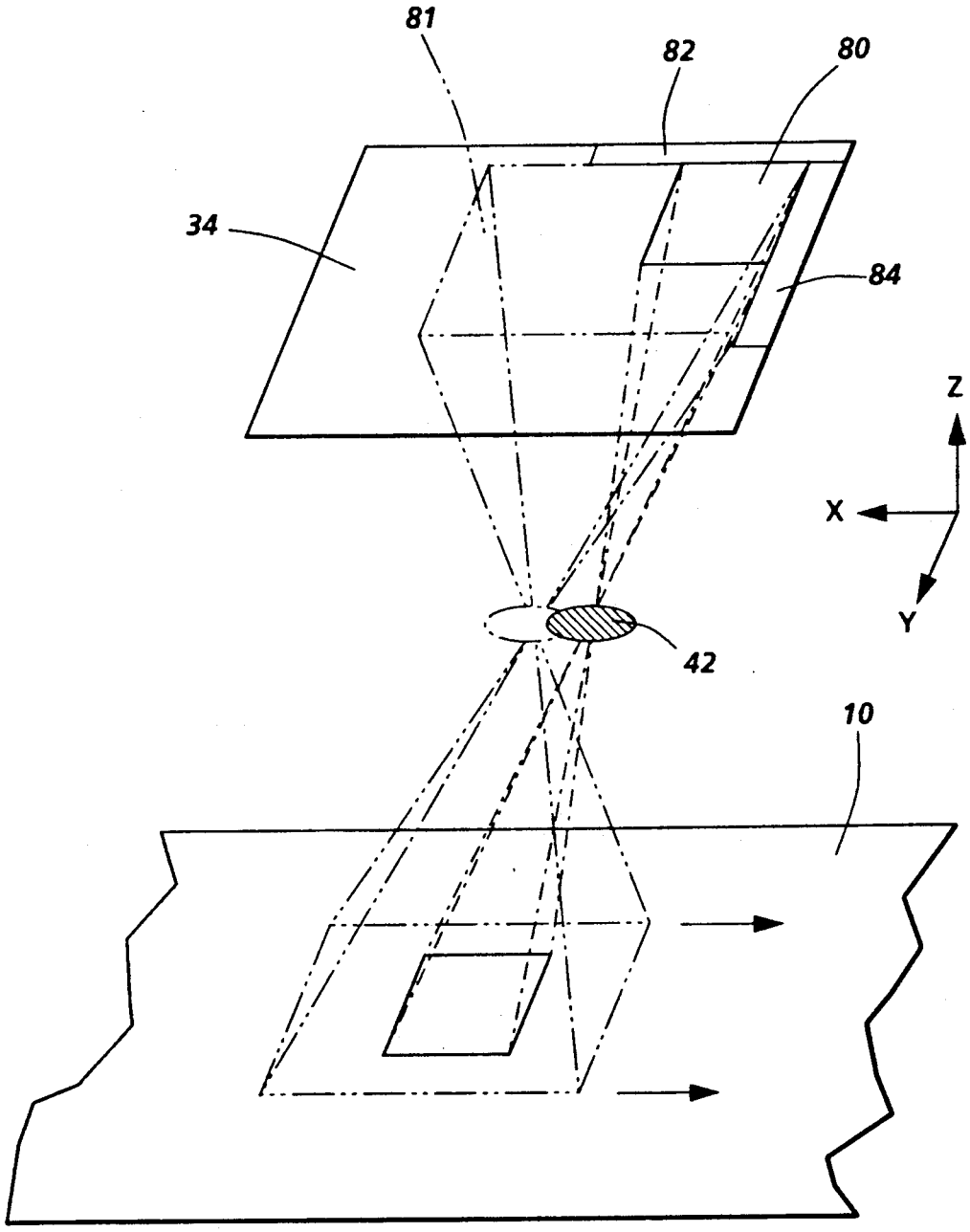
FIG. 2 is an isometric side view of the image positioning system of FIG. 1 showing document registration position.

Referring now more particularly to FIG. 2, with continued reference to FIG. 1, the particular imaging system of the present invention will be described. It can be seen from FIG. 2 that a number of possible output image copy positions can be accommodated by appropriate movement of lens 42 in the X, Y plane to allow the operator to shift the corner registration of the output image either vertically or horizontally on the photoreceptor 10 and, in turn, on the output copy sheet. FIG. 2 shows the top of platen 34 with an original image document 80 registered in a manual mode within an A4 (8½ by 11 inch) original document footprint 81. In FIG. 2, the operator has placed the top edge of document 80 on platen 34 adjacent to fixed, raised manual registration edges 82, 84. The output system typical of most reproduction systems would reproduce the original document image at a position on the output document corresponding to the position of the original document. However, by selecting a selective corner registration shift via a user interface device (described later herein), the operator transmits an electrical signal to the lens drive circuit 50 through associated control circuitry in order to move lens 42 to the projection position appropriate to suit the customer's needs. For an illustrative example, appropriate lens movement is initiated via control circuit 50 to move the lens in an inboard direction (in the Y direction) and to the right (in the X direction) in order to shift the image to a centered position on the output document, as illustrated in FIG. 2.

Thus, FIG. 2 illustrates an exemplary corner registration shift of the output image using the present invention, wherein two lens positions associated with the variable operator selected output image positions are shown. In this example, lens 42 has been translated along X, Y coordinates so as to shift the corner registration of the original image to a selected position, providing a centered image on the output copy sheet. In this manner, an operator can position an original image at various positions on an output copy sheet. It will be appreciated by those of skill in the art that the image shift feature of the present invention is adaptable for use in conjunction with variable magnification and/or in situations in which input documents and output copy paper are of different sizes.

The present invention provides an algorithm which has been developed and implemented for repositioning the optical lens system of the present invention by allowing an operator to input an image shift selection through a user interface device. The user interface provides electrical signals to control circuitry coupled to at least one stepper motor for driving the optical system. According to one aspect of the invention, the lens can be moved in three-dimensions as a function of image shift selection as well as magnification selection. Alternatively, or in addition, lens positioning is also made to be dependent upon selective copy sheet sizing or document handling mode.

Figure 3:
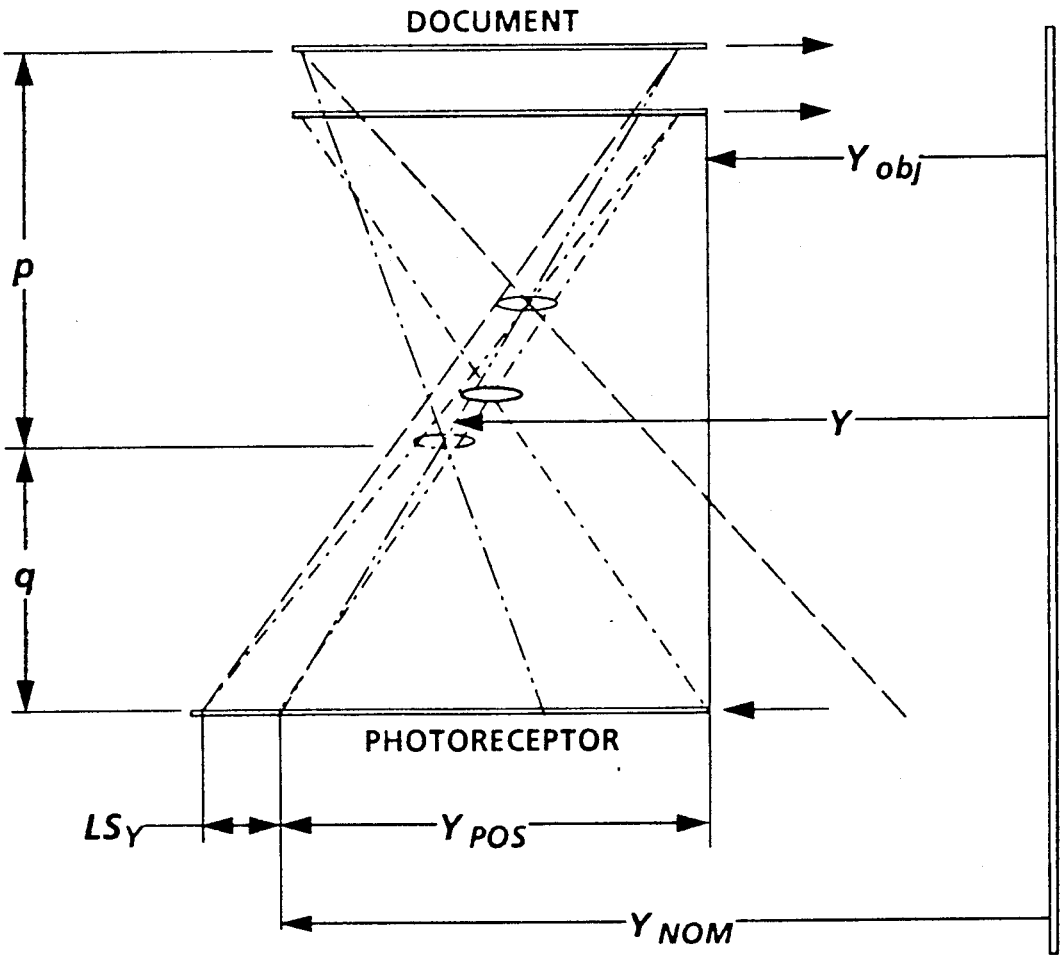
FIG. 3 is a representation of the lens position coordinate system relative to the machine coordinate system of the exemplary embodiment described herein.

The method of enabling the required X, Y coordinate lens shift will now be described with reference to FIGS. 3 and 4. FIG. 3 shows a side view of the imaging system of FIG. 1, depicted in two dimensions and in schematic form in the interest of simplicity. $Y_{pos}$ is an adjustable parameter representing the "Y" distance between the image location on the photoreceptor and the actual object location on the platen. This value is an adjustable minimum value input to the applications code of the particular machine at the time of system installation and set-up by a technical representative or other technical personnel to provide correct "Y" registration of the output copy with respect to the edge of the copy paper at the transfer station. $Y_{pos}$ is a unique value for each document handling mode (i.e., manual, semi-automatic document handler (SADH), recirculating document handler (RDH), continuous forms feeder (CFF)). $Y_{nom}$ is a constant value equal to the "Y" distance between the nominal datum location and the image location on the photoreceptor. Thus, initial system set-up for proper image registration is achieved by adjusting $Y_{pos}$ to a "home" position so as to align the output image on the output copy sheet. The lens position along the Y-axis for any given magnification (MS=q/p) is established by the following expression:

$$Y = Y_{nom} - Y_{pos}\left(\frac{MS}{1 + MS}\right) - LS_y\left[\frac{1}{1 + MS}\right] \quad (1)$$

Likewise, the lens position along the X-axis is given by:

$$X = X_{nom} - X_{pos}\left(\frac{MS}{1 + MS}\right) - LS_x\left[\frac{1}{1 + MS}\right] \quad (2)$$

where $X_{nom}$ is a value adjusted by a technical service representative at the time of machine set-up to properly position the image on the photoreceptor with respect to a predetermined field stop.

$LS_y$ and $LS_x$ refer to the distance along the "Y" and "X" coordinates, respectively, that the image is shifted with respect to the orientation of the output copy sheet. Solving equations 1 and 2 for $LS_y$ and $LS_x$, respectively, provides a basis for defining the amount of lens movement required to provide the corresponding amount of image shift input by the operator, as follows:

$$LS_y = \left(Y - Y_{nom} - Y_{pos}\left(\frac{MS}{1 + MS}\right)\right)(1 + MS) \quad (3)$$

$$LS_x = -\left(X - X_{nom} - X_{pos}\left(\frac{MS}{1 + MS}\right)\right)(1 + MS) \quad (4)$$

Figure 4:
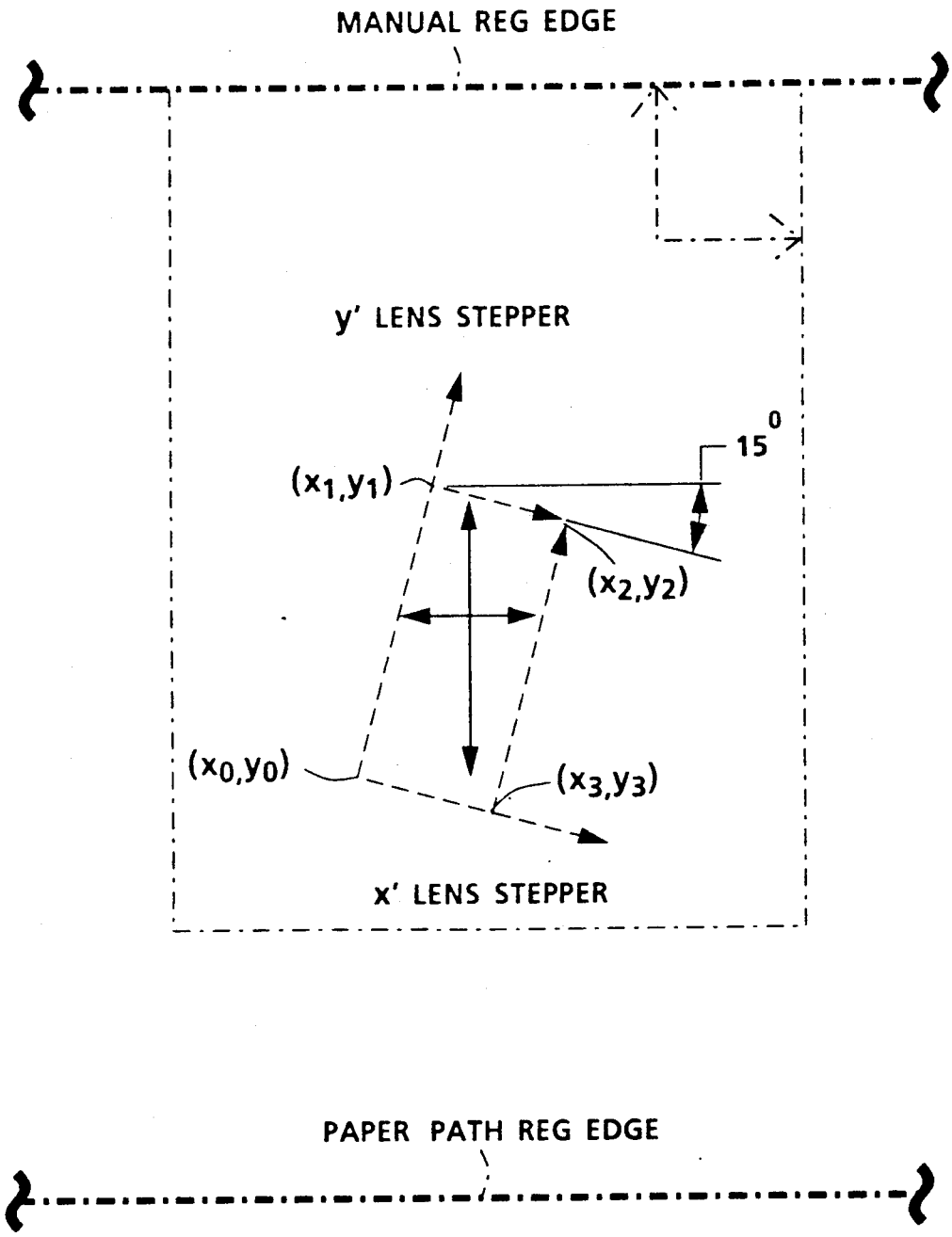
FIG. 4 is a top schematic view of the imaging system of FIG. 1, showing the lens X and Y coordinate algorithm derivation of the present invention.

In a preferred embodiment, the optical system lens 42 is driven along axes which are translated and rotated 15 degrees with respect to the machine platen, as shown in FIG. 4. Thus, equations 3 and 4 can be solved with respect to the specific architecture of the preferred embodiment to define the limits for which the lens can be reliably moved. For example, the right limit can be determined by solving equation 3 to find the X values of lines passing through point $x_2$, $y_2$ having slopes −15 degrees and 75 degrees, respectively, as follows:

$$\text{RightLimit} = \text{MIN}[X_0 - x, x_0 - x'] * (1 + MS) = \quad (5)$$

$$\text{MIN}\left[X_{nom} - X_{pos} * \left(\frac{MS}{1 + MS}\right) - x_2 - 0.2679 * (Y - y_2),\right.$$

$$\left. X_{nom} - X_{pos} * \left(\frac{MS}{1 + MS}\right) - x_2 + 3.7321 * (Y - y_2)\right] * (1 + MS)$$

Figure 5:
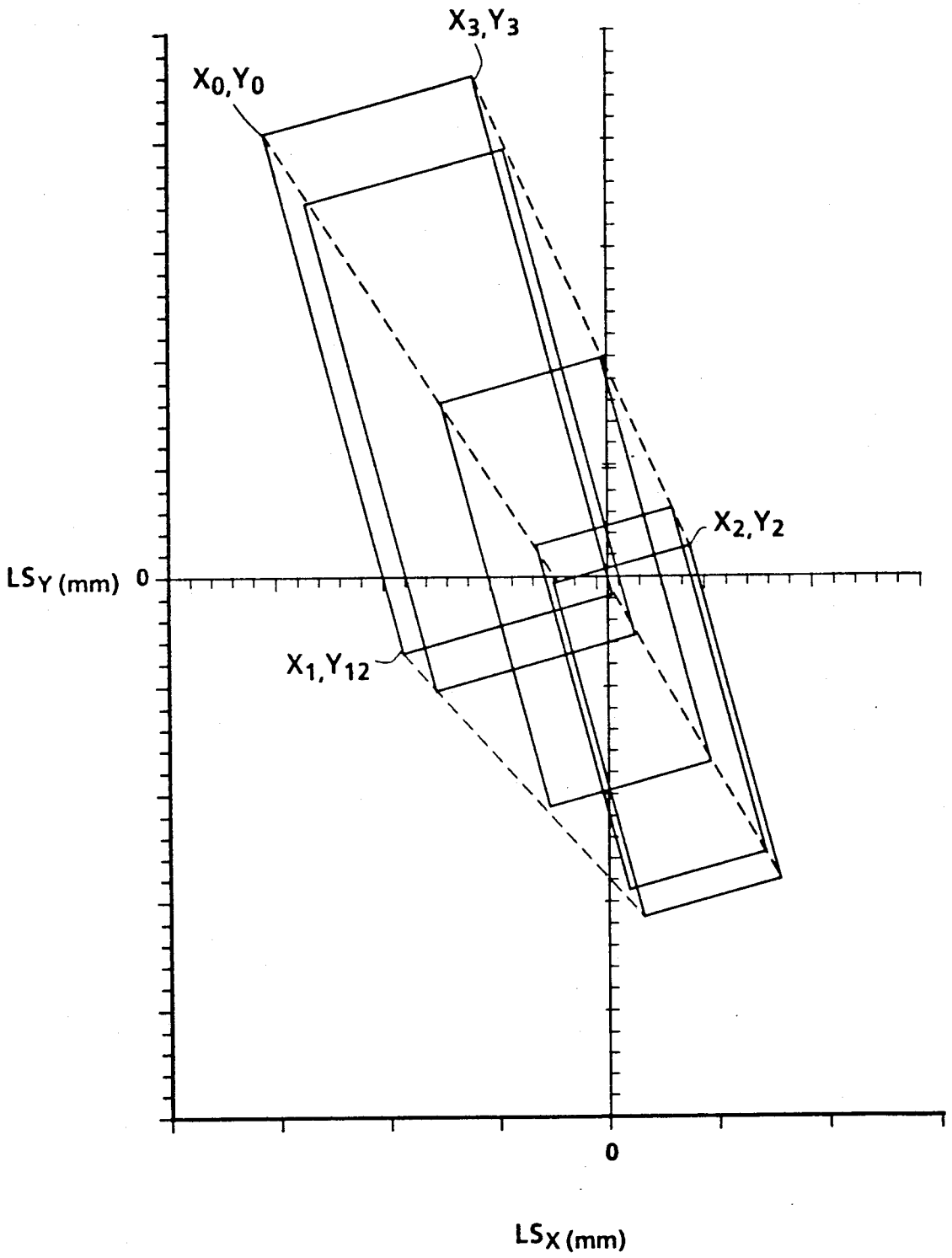
FIG. 5 is top view of the document platen showing the image positioning envelope for various magnifications.

Equivalent solutions are also determined for the left limit as well as the up and down limits in the same manner as provided above. The solutions to these equations are inserted into an algorithm which controls the optical system so as to prevent the machine from initiating a copy cycle if the corner registration shift requested by the operator is greater than the limits determined by the solution of the equations, thereby preventing a lens position selection which would not be reliably achievable due to the physical limitations on lens travel. FIG. 5 shows a graphic representation of the footprints of various exemplary image positioning envelopes for standard mode copies at various magnifications. It will be understood by one of skill in the art that such envelopes can also be developed for standard mode copies as well as for fanfold and oversize document sizes.

Figure 6:
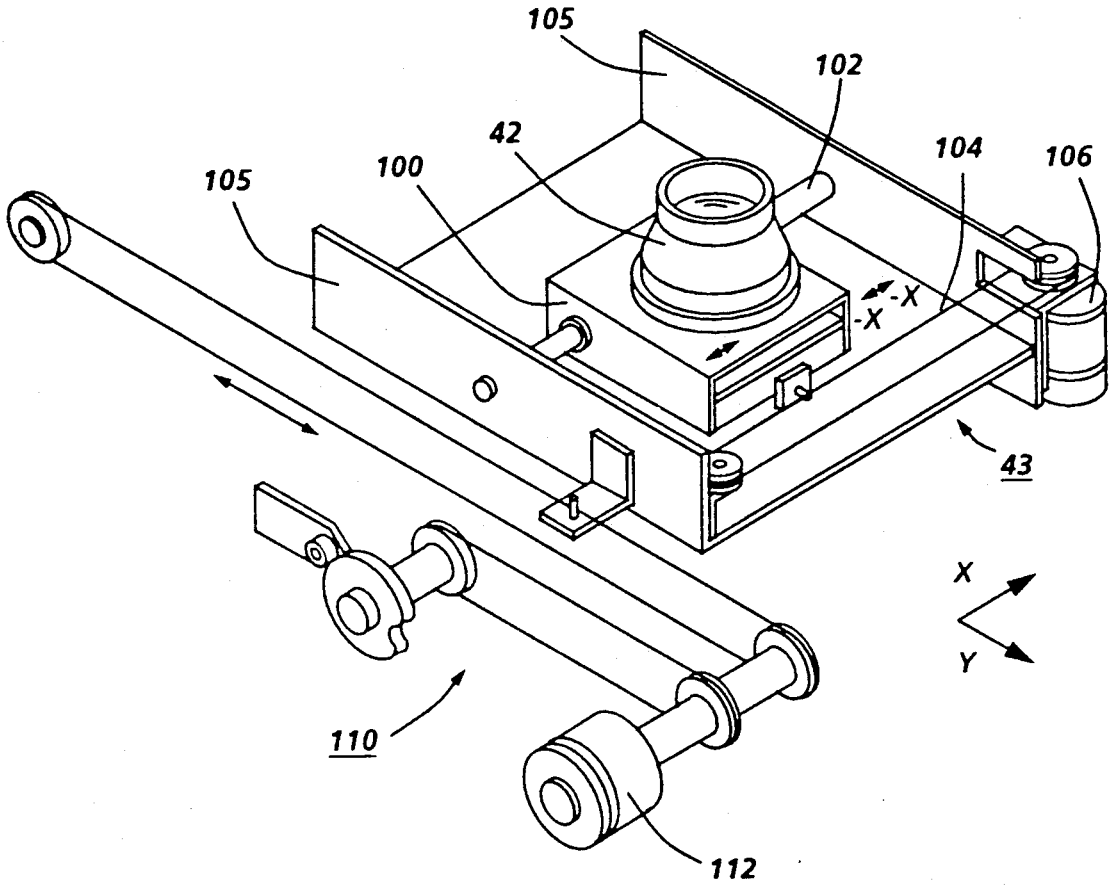
FIG. 6 is a perspective view of an embodiment of the lens drive carriage of the present invention.

FIG. 6 shows a perspective view of the lens carriage 43. As shown, lens 42 is mounted on a first carriage 100 adapted to move in the ±X direction along a guide rail 102. The carriage 100 is driven by a pulley/cable arrangement 104 driven by DC stepper motor 106. A second lens carriage 105 is adapted to move in the ±Y direction. Carriage 105 is driven by a pulley/cable arrangement 110 driven by stepper motor 112. Controller 54 provides input signals to drive the X and Y stepper motors 106, 112, respectively, which, in turn provide the lens horizontal translational motion. Input signals to stepper motors 106, 112 are derived from the equations explained hereinabove.

The above lens positioning description does not take into account changes in magnification selection. Upon a magnification change, the lens undergoes a third Z motion as can be seen in FIG. 3. Lens 42 is therefore translated toward or away from the photoreceptor by appropriate vertical movement of housing floor 46. Lens 42 is simultaneously translated along the X, Y coordinate axes to provide the appropriate corner registration shift selected by the operator.

Figure 7:
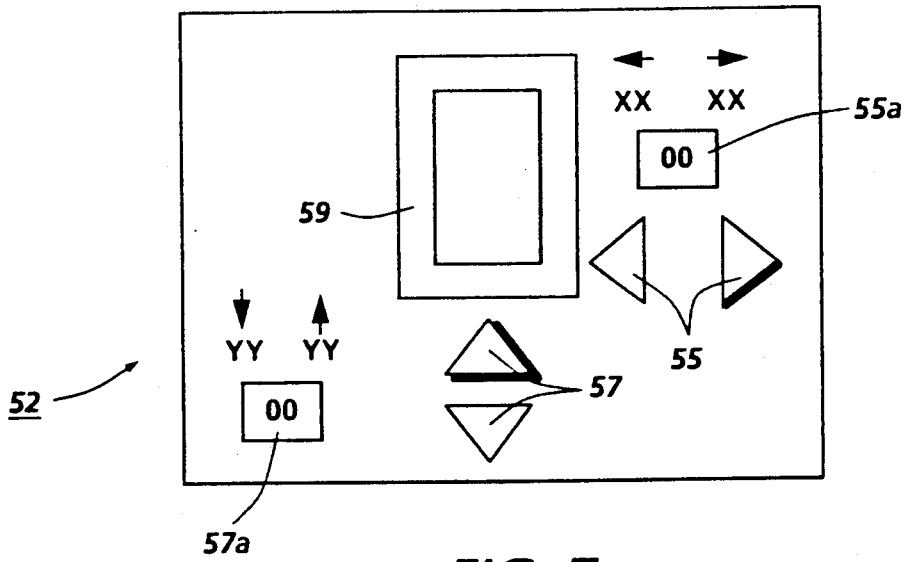
FIG. 7 is a pictorial view of a touch screen showing the operator selectable controls for selectively adjusting output copy image position.

Desired shift selection is conventionally made by an operator through a user interface device represented as reference numeral 52 in FIG. 1 and further illustrated in FIG. 7. By way of example, user interface device 52 may be a touch screen having a plurality of operator actuatable buttons displayed thereon such as a numerical keyboard for selecting number of copies, magnification control buttons, image contrast buttons, etc. FIG. 7 shows a shift control screen used to provide appropriate signals representative of the selected image shift on the output copy sheet relative to the original document. Thus, buttons 55, 57 allow the operator to shift the corner registration of the output image vertically and/or horizontally on the copy sheet. To move the image left or right the appropriate vertical shift selection switches 55 are pressed. Likewise, for movement of the image up or down on the copy paper, the appropriate horizontal shift selection switches 57 are selected. The numerical amount of image shift is displayed in 0.1 inch increments in display windows 55*a* and 57*a*, respectively. Further, a representation of the output image as shifted with respect to the output copy sheet is provided in rectangular display 59.

In recapitulation, the electrophotographic copying machine of the present invention is adapted to allow the customer to customize the image position of an original input document onto an output copy sheet. An operator can automatically provide for a selective corner registration shift via a user interface which transmits an electronic signal to control circuitry for actuating lens repositioning to shift the corner registration of the image on the copy paper vertically and/or horizontally. The present invention allows the customer to reposition most standard size images on most standard size copy papers in various document handling modes as well as in various magnification and duplexing modes.

It is, therefore, evident that there has been provided, in accordance with the present invention, an electrophotographic copying apparatus that fully satisfies the aims and advances of the invention as hereinabove set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An electrophotographic copying apparatus adapted to provide electrical signals representative of corner registration shift selection to selectively position an image on an output copy sheet, comprising:

a transparent platen for supporting an original input document;

an optical system including means for illuminating the original document, and a projection lens adapted for three-dimensional movement with respect to said platen for forming a latent image of the original input document on a photoconductive surface;

lens drive means coupled to said projection lens for actuating movement thereof; and control means coupled to said lens drive means and adapted to receive said electrical signals representative of corner registration shift selection for moving said projection lens in response to said control means such that said latent image is selectively positioned on said photoconductive surface to selectively position the image on the output copy sheet.

2. The electrophotographic copying apparatus of claim 1, further adapted to provide electrical signals representative of magnification selection to provide selective magnification of an image on an output copy sheet, wherein said control means is further adapted to receive said electrical signals representative of magnification selection for moving said projection lens in response thereto as a function of a particular corner registration shift selection.

3. The electrophotographic copying apparatus of claim 2, wherein said control means incorporates an algorithm for determining X and Y position coordinates of said projection lens in accordance with the following equations:

$$Y = Y_{nom} - Y_{pos}\left(\frac{MS}{1 + MS}\right) - LS_y\left[\frac{1}{1 + MS}\right] \quad (1)$$

$$X = X_{nom} - X_{pos}\left(\frac{MS}{1 + MS}\right) - LS_x\left[\frac{1}{1 + MS}\right] \quad (2)$$

where:

$X_{nom}$, $Y_{nom}$ are values representative of nominal datum location with respect to the image position on the photoconductive surface;

$X_{pos}$, $Y_{pos}$ are selective parameters representative of distance between image position on said photoconductive surface and the input document on the platen;

$LS_x$, $LS_y$ are values representative of distance the image is shifted with respect to the output copy sheet; and MS is a value representative of magnification selection given by a ratio of distance from said projection lens to said platen and said projection lens to said photoconductive surface.

4. The electrophotographic copying apparatus of claim 1, wherein said lens drive means includes at least one motor associated with the X component of motion and at least one motor associated with the Y component of motion, said control means being coupled to each said motor for providing said electrical signals representative of corner registration shift selection thereto.

5. The electrophotographic copying apparatus of claim 4, wherein each said motor is a DC stepper motor.

6. The electrophotographic copying apparatus of claim 1, wherein the input document is manually positioned on said platen.

7. The electrophotographic copying apparatus of claim 1, further including a document handling device for automatically transporting an input document onto said platen.

8. The electrophotographic copying apparatus of claim 1, further including a user interface device coupled to said control means, for inputting a particular corner registration shift selection to said imaging system.

9. The electrophotographic copying apparatus of claim 8, wherein said user interface device includes a touch screen having operator actuatable means for selecting said particular corner registration shift selection.

10. The electrophotographic copying apparatus of claim 8, wherein said user interface device further includes display means for displaying said particular corner registration shift selection.

11. The electrophotographic copying apparatus of claim 10, wherein said display means includes means for displaying said corner registration shift selection in terms of numerical increments.

12. The electrophotographic copying apparatus of claim 10, wherein said display means includes means for displaying said corner registration shift selection as a graphic representation of the image with respect to the output copy sheet.

13. An electrophotographic copying apparatus, comprising:

a user interface device adapted to provide operator input of a particular image shift selection for providing selective horizontal and vertical position shift of an image on an output copy sheet, said user interface device providing signals corresponding to the horizontal and vertical position shift of the image;

a transparent platen for supporting an original input document;

an optical system including means for illuminating the original document, and a projection lens adapted for movement with respect to said platen for forming a latent image of the original input document on a photoconductive surface;

lens drive means, coupled to said projection lens, for actuating movement thereof; and control means coupled to said lens drive means and adapted to receive said signals corresponding to horizontal and vertical position shift from said user interface device, for moving said projection lens in response to said control means such that said latent image is selectively positioned on said photoconductive surface to selectively position the image on the output copy sheet.

14. The electrophotographic copying apparatus of claim 13, wherein said projection lens is adapted for three-dimensional movement with respect to said platen.

15. The electrophotographic copying apparatus of claim 14, wherein said user interface device is further adapted to provide operator input of a particular magnification selection for providing selective magnification of an image on an output copy sheet, wherein said control means is further adapted to receive said particular magnification selection for moving of said projection lens in response thereto as a function of said particular image shift selection.

16. The electrophotographic copying apparatus of claim 15, wherein said control means incorporates an algorithm for determining X and Y position coordinates of said projection lens in accordance with the following equations:

$$Y = Y_{nom} - Y_{pos}\left\{\frac{MS}{1 - MS}\right\} - LS_y\left[\frac{1}{1 - MS}\right] \quad (1)$$

$$X = X_{nom} - X_{pos}\left\{\frac{MS}{1 - MS}\right\} - LS_x\left[\frac{1}{1 - MS}\right] \quad (2)$$

where:

$X_{nom}$, $Y_{nom}$ are values representative of nominal datum location with respect to the image position on the photoconductive surface;

$X_{pos}$, $Y_{pos}$ are selective parameters representative of distance between image position on said photoconductive surface and the input document on the platen;

$LS_x$, $LS_y$ are values representative of the distance the image is shifted with respect to the output copy sheet; and MS is a value representative of magnification selection given by a ratio of distance from said projection lens to said platen and said projection lens to said photoconductive surface.

17. The electrophotographic copying apparatus of claim 14, wherein said lens drive means includes at least one motor associated with the X component of motion and at least one motor associated with the Y component of motion, said control means being coupled to each said motor for providing said particular image shift selection thereto.

18. The imaging system of claim 17, wherein each said motor is a DC stepper motor.

19. The electrophotographic copying apparatus of claim 14, wherein the input document is manually positioned on said platen.

20. The electrophotographic copying apparatus of claim 14, further including a document handling device for automatically transporting an input document onto said platen.

21. The electrophotographic copying apparatus of claim 14, wherein said user interface device includes a touch screen having operator actuatable means for selecting said particular image shift selection.

22. The electrophotographic copying apparatus of claim 14, wherein said user interface device further includes display means for displaying said particular image shift selection.

23. The electrophotographic copying apparatus of claim 22, wherein said display means includes means for displaying said particular image shift selection in terms of numerical increments.

24. The electrophotographic copying apparatus of claim 22, wherein said display means includes means for displaying a graphic representation of said particular image shift selection with respect to the output copy sheet.

* * * * *